US009174453B1

(12) United States Patent
Dodd et al.

(10) Patent No.: US 9,174,453 B1
(45) Date of Patent: Nov. 3, 2015

(54) MICROFLUIDIC REFILL CARTRIDGE HAVING A VENT HOLE AND A NOZZLE PLATE ON SAME SIDE

(71) Applicant: STMicroelectronics, Inc., Coppell, TX (US)

(72) Inventors: Simon Dodd, West Linn, OR (US); Joe Scheffelin, Poway, CA (US); Dave Hunt, San Diego, CA (US); David Burney, Ramona, CA (US)

(73) Assignee: STMicroelectronics, Inc., Coppell, TX (US)

( * ) Notice: Subject to any disclaimer, the term of this patent is extended or adjusted under 35 U.S.C. 154(b) by 0 days.

(21) Appl. No.: 14/311,022

(22) Filed: Jun. 20, 2014

(51) Int. Cl.
*B41J 2/175* (2006.01)
*B41J 2/14* (2006.01)

(52) U.S. Cl.
CPC ..... *B41J 2/17506* (2013.01)

(58) Field of Classification Search
USPC ..... 347/47, 49, 50, 63, 64, 66, 85, 86; 73/753, 754
See application file for complete search history.

(56) References Cited

U.S. PATENT DOCUMENTS

| | | | | |
|---|---|---|---|---|
| 5,850,238 | A * | 12/1998 | Karita et al. | 347/29 |
| 6,033,063 | A * | 3/2000 | Tomikawa et al. | 347/87 |
| 7,188,936 | B2 * | 3/2007 | Usui et al. | 347/85 |

* cited by examiner

*Primary Examiner* — Anh T.N. Vo
(74) *Attorney, Agent, or Firm* — Seed IP Law Group PLLC

(57) ABSTRACT

Embodiments disclosed herein are directed to a microfluidic refill cartridge having a vent hole and nozzles on a same side of the cartridge. In one or more embodiments, the vent hole and nozzles are located on upper surfaces of the cartridge, such as on a lid that is coupled to a reservoir. In particular, the nozzles and the vent hole may be formed on a microfluidic delivery member that is secured to the lid. A single cover may be used to cover the vent hole and the nozzles. In some embodiments, the single cover may be a flexible material and may adhere to the microfluidic delivery member.

24 Claims, 15 Drawing Sheets

MICROFLUIDIC REFILL CARTRIDGE HAVING A VENT HOLE AND A NOZZLE PLATE ON SAME SIDE

BACKGROUND

1. Technical Field

Embodiments are directed to microfluidic delivery systems that include fluid dispensing refill cartridges and methods of sealing the same.

2. Description of the Related Art

Fluid delivery systems that include refill cartridges are currently being used in the printer industry. Many printers, including 3D printers, use replaceable inkjet cartridges that incorporate an ink reservoir and a print head for delivering ink from the reservoir to the paper. The print head is usually located below the ink reservoir. Typically, the inkjet cartridges have nozzles for expelling the ink located below the ink reservoir and a vent hole on the top side of the ink reservoir for equalizing the pressure in the ink reservoir. Thus, the nozzles and vent hole are located on opposing surfaces of the inkjet cartridges.

Both the vent hole and the nozzles are preferably sealed when not in use to prevent leakage and evaporation of the ink. With the vent hole and the nozzles on opposing surfaces, a two-step process may be performed for sealing. For instance, a first step may be performed to seal the vent hole and a second step may be performed to seal the nozzles. Alternatively, a large cover that wraps around opposing surfaces and along a side surface of the cartridge may be used to seal the cartridge and the vent hole.

BRIEF SUMMARY

Embodiments disclosed herein are directed to a microfluidic refill cartridge having a vent hole and nozzles on a same side of the cartridge. In one or more embodiments, the vent hole and nozzles are located on upper surfaces of the cartridge, such as on a lid that is coupled to a reservoir. In particular, the nozzles and the vent hole may be formed on a microfluidic delivery member that is secured to the lid. Thus, a single cover may be used to cover the vent hole and the nozzles. In some embodiments, the single cover may be a flexible material and may adhere to the microfluidic delivery member.

The nozzles may be formed in a nozzle plate of a die that is secured to an upper surface of microfluidic delivery member, while the vent hole may be formed in a surface of the microfluidic delivery member. In some embodiments, the nozzle plate has an upper surface that lies in a different plane from the upper surface of the microfluidic delivery member. Thus, the cover may include a flexible material that conforms to the upper surface of the nozzle plate and the upper surface of the microfluidic delivery member. In one embodiment, the cover includes an inner flexible portion that is located above the nozzles and the vent hole and an outer hard portion. It is to be appreciated that a single processing step may be used to seal the nozzles and the vent hole. In addition, the nozzles and vent hole may be located close together so that the cover may be small and use a small amount of material.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1:
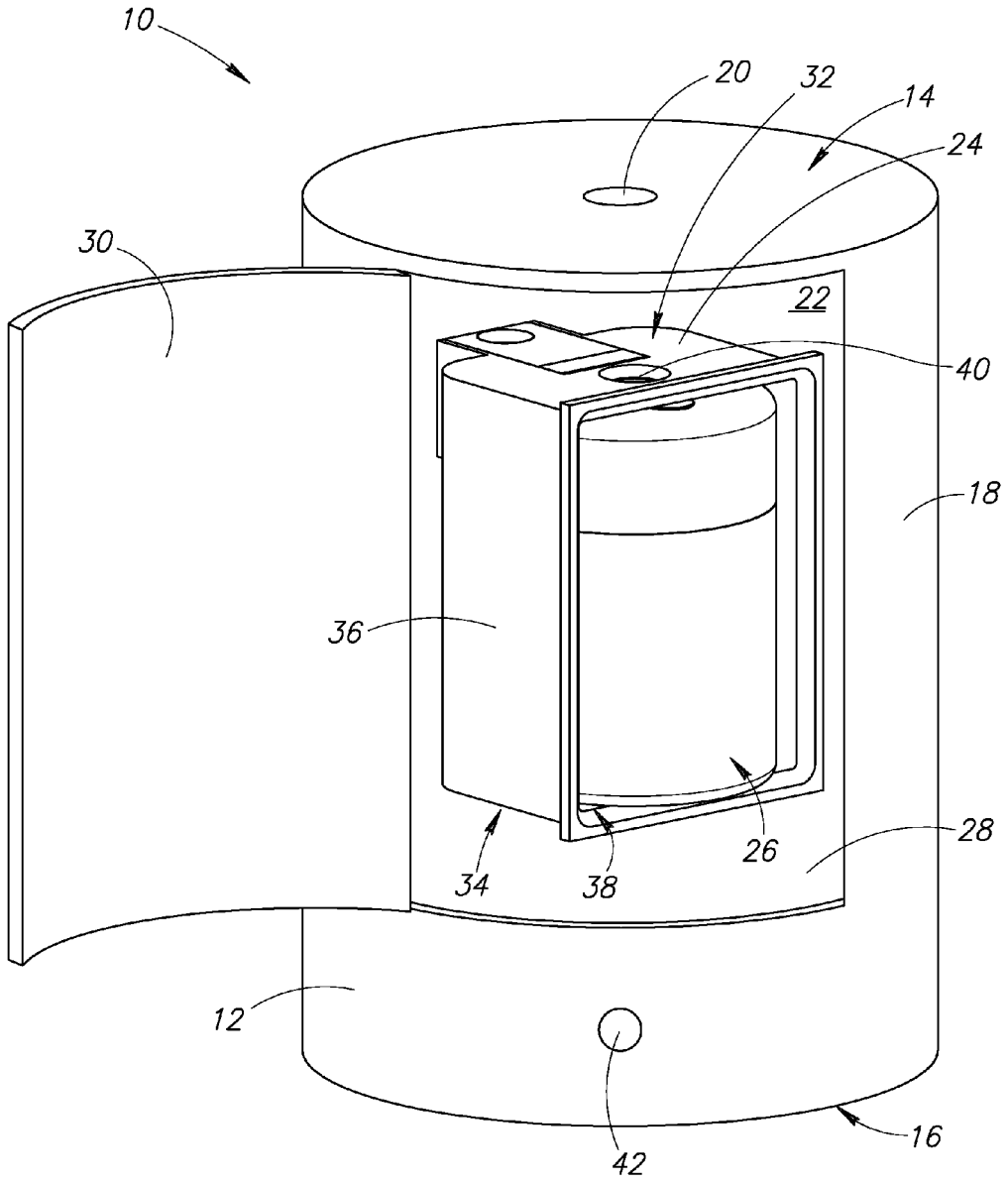
FIG. 1 is a schematic isometric view of a microfluidic delivery system in accordance with one embodiment.

FIG. 1 illustrates a microfluidic delivery system 10 in accordance with one embodiment of the disclosure. The microfluidic delivery system 10 includes a housing 12 having an upper surface 14, a lower surface 16, and a body portion 18 between the upper and lower surfaces. The upper surface of the housing 12 includes a first hole 20 that places an environment external to the housing 12 in fluid communication with an interior portion 22 of the housing 12. The interior portion 22 of the housing 12 includes a holder member 24 that holds a removable microfluidic refill cartridge 26. As will be explained below, the microfluidic delivery system 10 is configured to use thermal energy to deliver fluid from within the microfluidic refill cartridge 26 to an environment external to the housing 12.

Access to the interior portion 22 of the housing is provided by an opening 28 in the body portion 18 of the housing 12. The opening 28 is accessible by a cover or door 30 of the housing 12. In the illustrated embodiment, the door 30 rotates to provide access to the opening 28. Although the opening and door are located on the body portion of the housing, it is to be appreciated that the opening and door may also be located on the upper surface and the lower surface of the housing. Furthermore, it is to be appreciated that in other embodiments, the housing has two or more separable parts for providing access to the interior portion.

The holder member 24 includes an upper surface 32 and a lower surface 34 that are coupled together by one or more sidewalls 36 and has an open side 38 through which the microfluidic refill cartridge 26 can slide in and out. The upper surface 32 of the holder member includes an opening 40 that is aligned with the first hole 20 of the housing 12.

The holder member 24 holds the microfluidic refill cartridge 26 in position when located therein. In one embodiment, the holder member 24 elastically deforms, thereby gripping the microfluidic refill cartridge 26 in place when located in the holder member. In another embodiment, the holder member 24 includes a locking system (not shown) for holding the microfluidic refill cartridge in place. In one embodiment, the locking system includes a rotatable bar that extends across the open side of the holder member to hold the microfluidic refill cartridge in place.

The housing 12 includes conductive elements (not shown) that couple electrical components throughout the system as is well known in the art. The housing 12 may further include connection elements for coupling to an external or internal power source. The connection elements may be a plug configured to be plugged into an electrical outlet or battery terminals. The housing 12 may include a power switch 42 on a front of the housing 12.

Figure 2A:
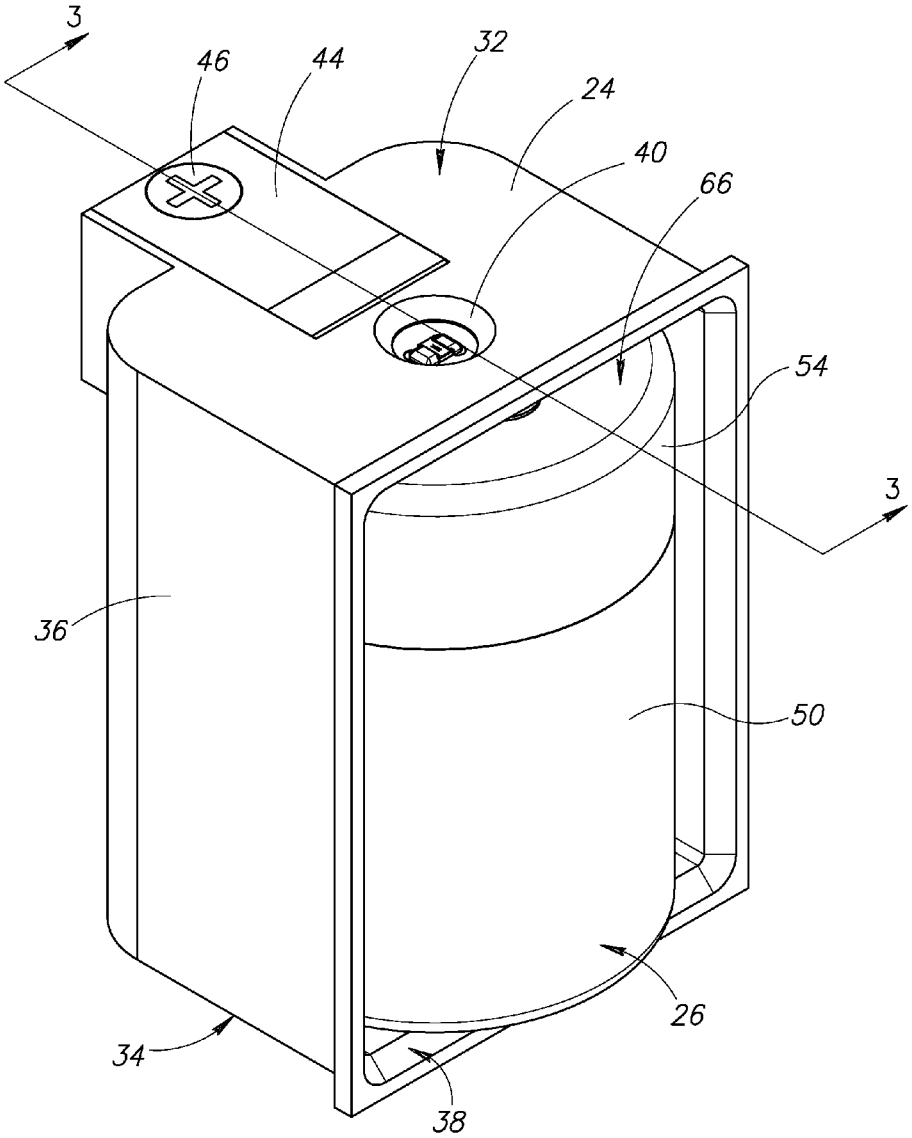
FIGS. 2A-2B are schematic isometric views of a microfluidic refill cartridge and a holder in accordance with one embodiment.
Figure 2B:
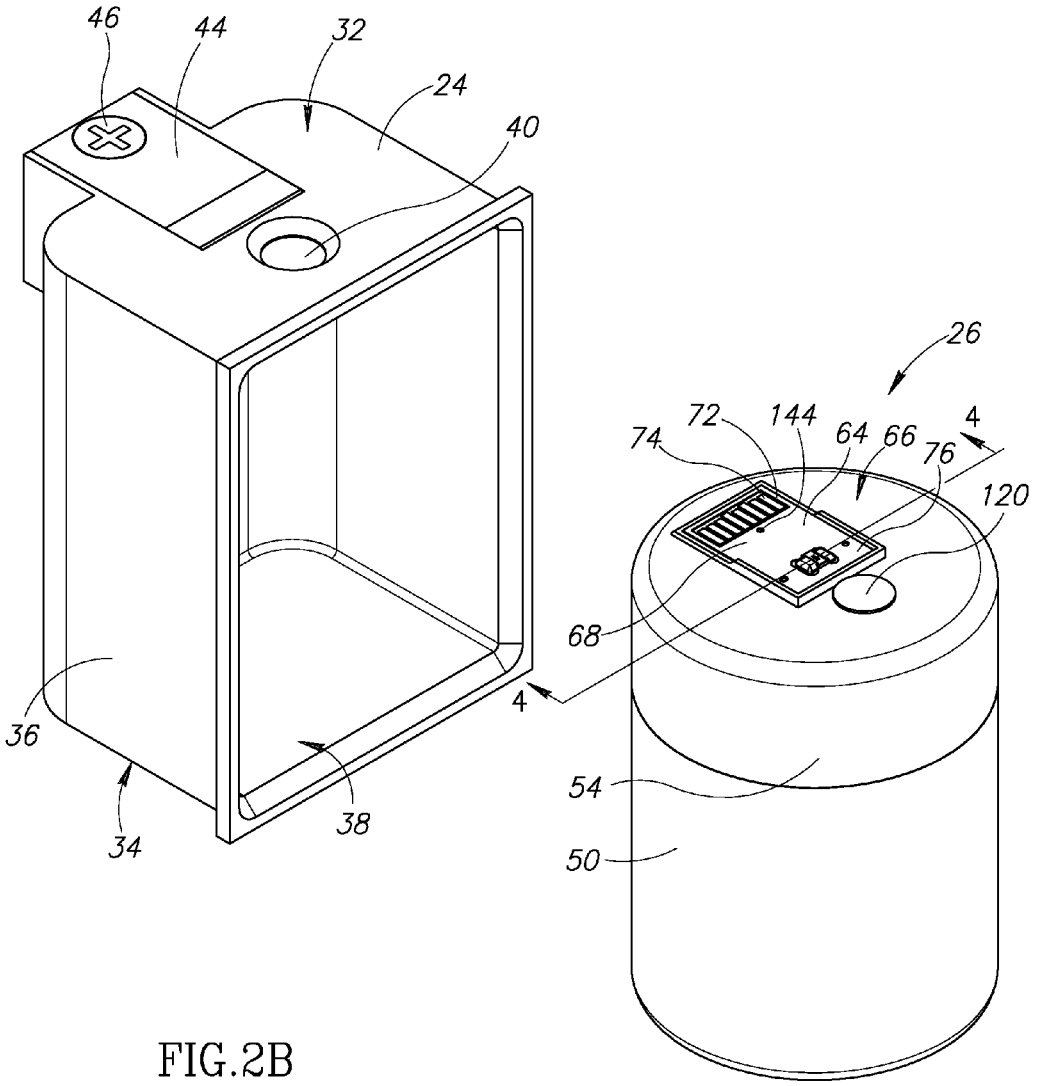

FIG. 2A shows the microfluidic refill cartridge 26 in the holder member 24 without the housing 12, and FIG. 2B shows the microfluidic refill cartridge 26 removed from the holder member 24. A circuit board 44 is coupled to the upper surface 32 of the holder member by a screw 46. As will be explained in more detail below, the circuit board 44 includes electrical contacts 48 (FIG. 3) that electrically couple to contacts of the microfluidic refill cartridge 26 when the cartridge is placed in the holder member. The electrical contacts 48 of the circuit board 44 are in electrical communication with the conductive elements.

Figure 3:
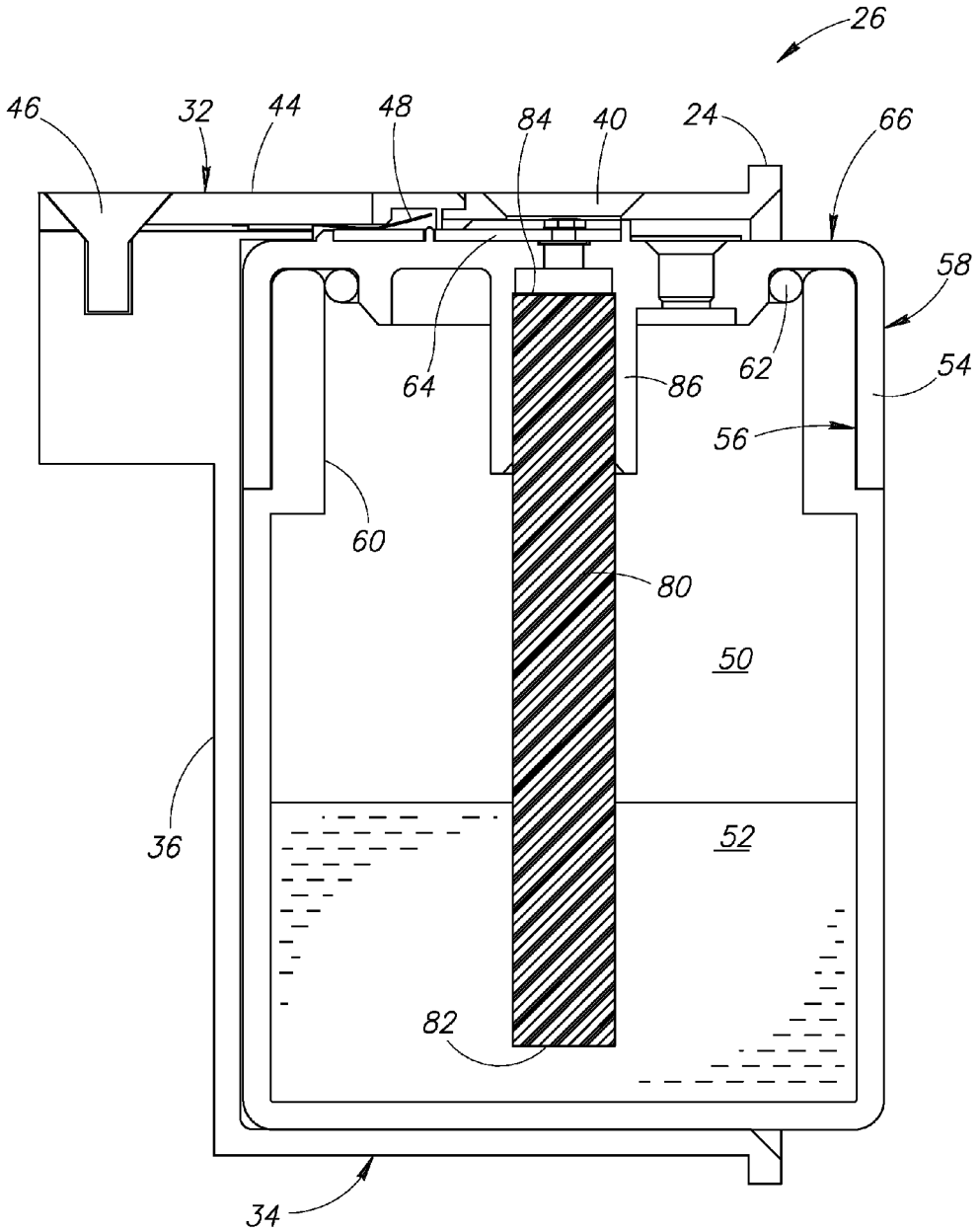
FIG. 3 is a cross-section schematic view of line 3-3 in FIG. 2A.

FIG. 3 is a cross-section view of the microfluidic refill cartridge 26 in the holder member 24 along the line 3-3 shown in FIG. 2A. With reference to FIG. 2B and FIG. 3, the microfluidic refill cartridge 26 includes a reservoir 50 for holding a fluid 52. The reservoir 50 may be any shape, size, or material configured to hold any number of different types of fluid. The fluid held in the reservoir may be any liquid composition. In one embodiment, the fluid is an oil, such as a scented oil. In another embodiment, the fluid is water. It may also be alcohol, a perfume, a biological material, a polymer for 3-D printing, or other fluid.

A lid 54, having an inner surface 56 and an outer surface 58, is secured to an upper portion 60 of the reservoir 50 to cover the reservoir 50. The lid 54 may be secured to the reservoir in a variety of ways known in the art. In some embodiments, the lid 54 is releasably secured to the reservoir 50. For instance, the lid 54 and the upper portion 60 of the reservoir 50 may have corresponding threads, or the lid 54 may snap onto the upper portion 60 of the reservoir 54. Between the lid 54 and the reservoir 50 there may be an O-ring 62 for forming a seal therebetween. The seal may prevent fluid from flowing therethrough as well as prevent evaporation of the fluid to an external environment.

A microfluidic delivery member 64 is secured to an upper surface 66 of the lid 54 of the microfluidic refill cartridge 26 as is best shown in FIG. 2B. The microfluidic delivery member 64 includes an upper surface 68 and a lower surface 70 (see also FIG. 4). A first end 72 of the upper surface 68 includes electrical contacts 74 for coupling with the electrical contacts 48 of the circuit board 44 when placed in the holder member 24. As will be explained in more detail below, a second end 76 of the microfluidic delivery member 64 includes a fluid path for delivering fluid therethrough.

In reference to FIG. 3, inside the reservoir 50 is a fluid transport member 80 that has a first end 82 in the fluid 52 in the reservoir and a second end 84 that is above the fluid 52. The fluid 52 travels from the first end 82 of the fluid transport member 80 to the second end 84 by capillary action. In that regard, the fluid transport member 80 includes one or more porous materials that allow the fluid to flow by capillary action. The construction of the member 80 permits fluid to travel through the fluid transport member 80 against gravity. Fluid can travel by wicking, diffusion, suction, siphon, vacuum, or other mechanism. The second end 84 of the transport member is located below the microfluidic delivery member 64. The fluid transport member 80 delivers fluid 52 from the reservoir 50 toward the microfluidic delivery member 64.

Figure 4:
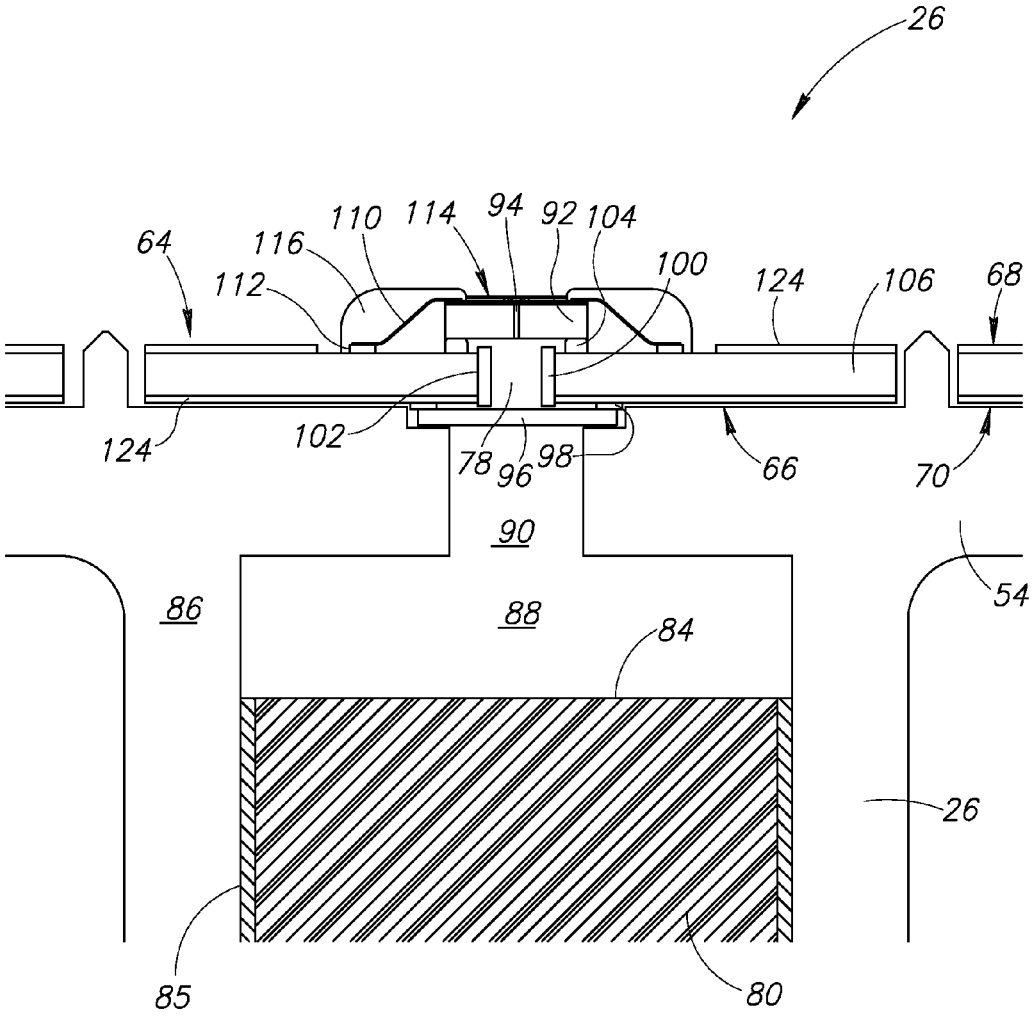
FIG. 4 is a cross-section schematic view of line 4-4 in FIG. 2B.

As best shown in FIG. 4, the second end 84 of the fluid transport member 80 is surrounded by a transport cover 86 that extends from the inner surface of the lid 54. The second end 84 of the fluid transport member 80 and the transport cover 86 form a chamber 88. The chamber 88 may be substantially sealed between the transport cover 86 and the second end 84 of the fluid transport member 80 to prevent air from the reservoir 50 from entering the chamber 88.

Above the chamber 88 is a first through hole 90 in the lid 54 that fluidically couples the chamber 88 above the second end 84 of the fluid transport member 80 to a second through hole 78 of the microfluidic delivery member 64. The microfluidic delivery member 64 is secured to the lid 54 above the first through hole 90 of the lid 54 and receives fluid therefrom.

In some embodiments, the fluid transport member 80 includes a polymer; non-limiting examples include polyethylene (PE), including ultra-high molecular weight polyethylene (UHMW), polyethylene terephthalate (PET), polypropylene (PP), nylon 6 (N6), polyester fibers, ethyl vinyl acetate, polyvinylidene fluoride (PVDF), and polyethersulfone (PES), polytetrafluroethylene (PTFE). The fluid transport member 80 may be in the form of woven fibers or sintered beads. It is also to be appreciated that the fluid transport member of the present disclosure may be smaller than reservoir. This is distinct from cartridges that include foam which fills the reservoir.

As shown in FIG. 4, the fluid transport member 80 may include an outer sleeve 85 that surrounds radial surfaces of the fluid transport member 80 along at least a portion of its length while keeping the first and second ends 82, 84 of the fluid transport members 80 exposed. The sleeve 85 may be made from a non-porous material or a material that is less porous than the fluid transport member 80. In that regard, the sleeve 85 may prevent or at least reduce air in the reservoir from entering the fluid transport member 80 by radial flow.

The outer sleeve 85 may be a material that is wrapped around the fluid transport member 80. In other embodiments, the material 85 is formed on the fluid transport member 80 in an initial liquid state that dries or sets on the fluid transport member. For instance, the material may be sprayed on the fluid transport member or the fluid transport member may be dipped into a liquid material that dries. The outer sleeve may be a polymer sheet, a Teflon tape, a thin plastic layer, or the like. Teflon tape has particular benefits since it provides a fluid-tight seal, is flexible to wrap, is strong, and also makes it easy to slip member 80 into place.

The fluid transport member 80 may be any shape that is able to deliver fluid 52 from the reservoir 50 to the microfluidic delivery member 64. Although the fluid transport member 80 of the illustrated embodiment has a width dimension, such as diameter, that is significantly smaller than the reservoir, it is to be appreciated that the diameter of the fluid transport member 80 may be larger and in one embodiment substantially fills the reservoir 50.

Figure 5A:
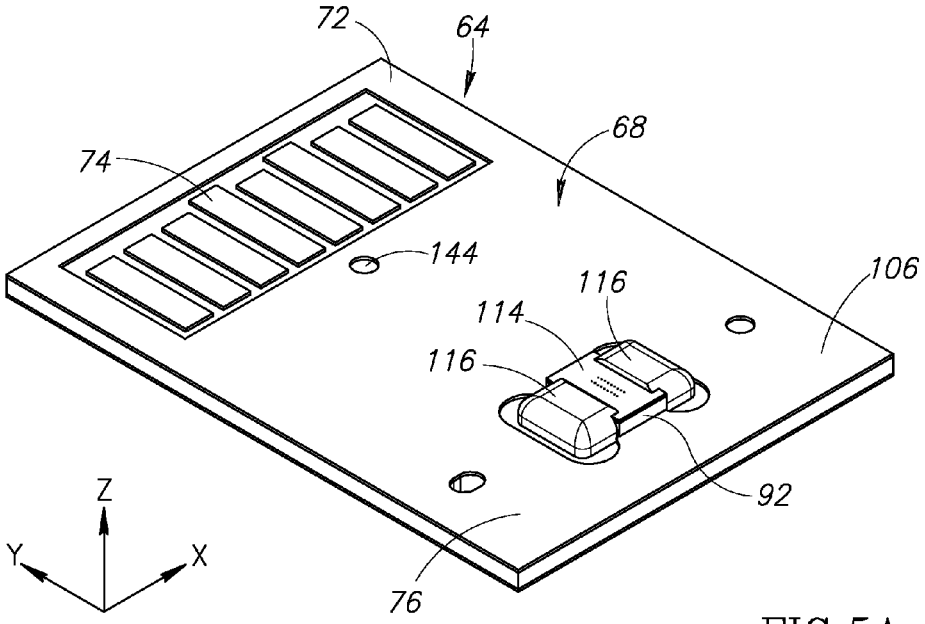
FIGS. 5A-5B are schematic isometric views of a microfluidic delivery member in accordance with an embodiment.
Figure 5B:
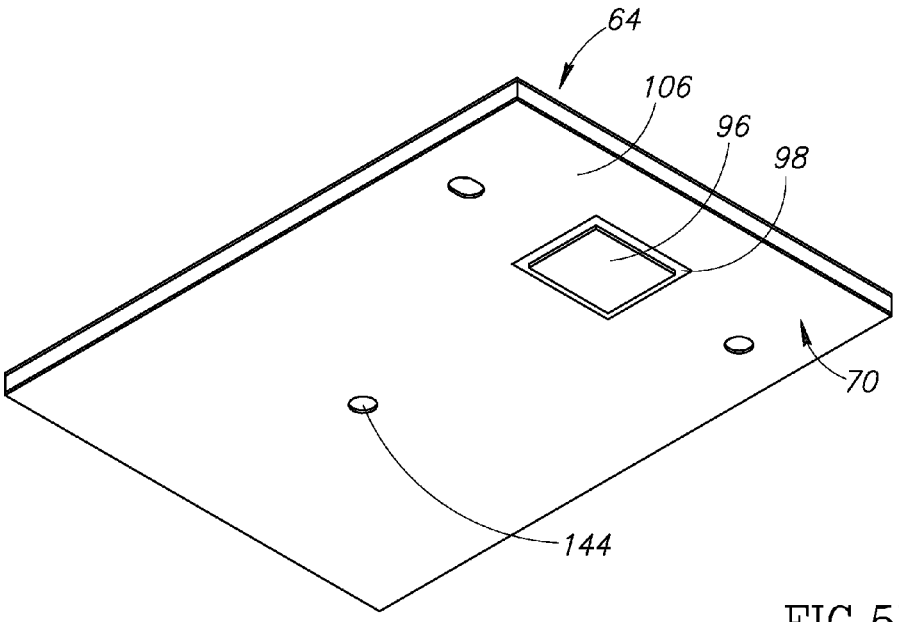
Figure 5C:
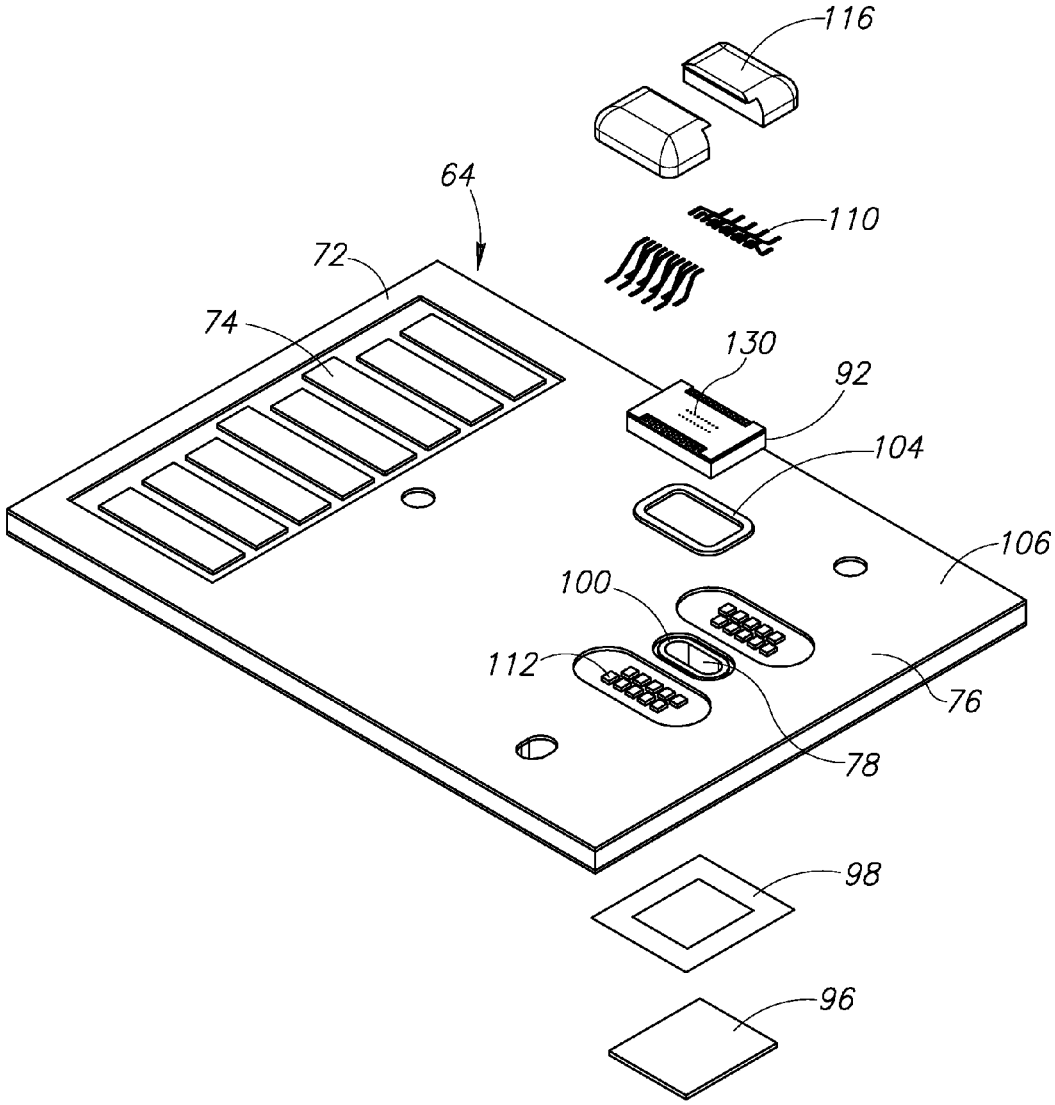
FIG. 5C is an exploded view of the structure in FIG. 5A.

FIGS. 5A and 5B, respectively, are top and bottom views of the microfluidic delivery member 64 in accordance with one embodiment. FIG. 5C illustrates the microfluidic delivery member 64 in exploded view. The microfluidic delivery member 64 includes a rigid planar circuit board, which can be a printed circuit board (PCB) 106 having the upper and lower surfaces 68, 70. The PCB 106 includes one or more layers of insulative and conductive materials as is well known in the art. In one embodiment, the circuit board includes FR4, a composite material composed of woven fiberglass cloth with an epoxy resin binder that is flame resistant. In other embodiments, the circuit board includes ceramic, glass or plastic.

The upper surface 68 of the second end 76 of the printed circuit board 106 includes a semiconductor die 92 above the second through hole 78 and leads 112 located proximate the die 92. Electrical contacts 74 at the first end 72 of the microfluidic delivery member 64 are coupled to one or more of the leads 112 at the second end 76 by electrical traces (not shown).

The upper and lower surfaces 68, 70 of the PCB 106 may be covered with a solder mask 124 as shown in the cross-section view of FIG. 4. Openings in the solder mask 124 may be provided where the leads 112 are positioned on the circuit board or at the first end 72 where the electrical contacts 74 are formed. The solder mask 124 may be used as a protective layer to cover electrical traces.

The die 92 is secured to the upper surface 68 of the printed circuit board 106 by any adhesive material 104 configured to hold the semiconductor die to the PCB. The adhesive material may be an adhesive material that does not readily dissolve by the fluid in the reservoir. In some embodiments, the adhesive material is activated by heat or UV. In some embodiments, a mechanical support (not shown) may be provided between a bottom surface 108 of the die 92 and the upper surface 68 of the printed circuit board 106.

Figure 6:
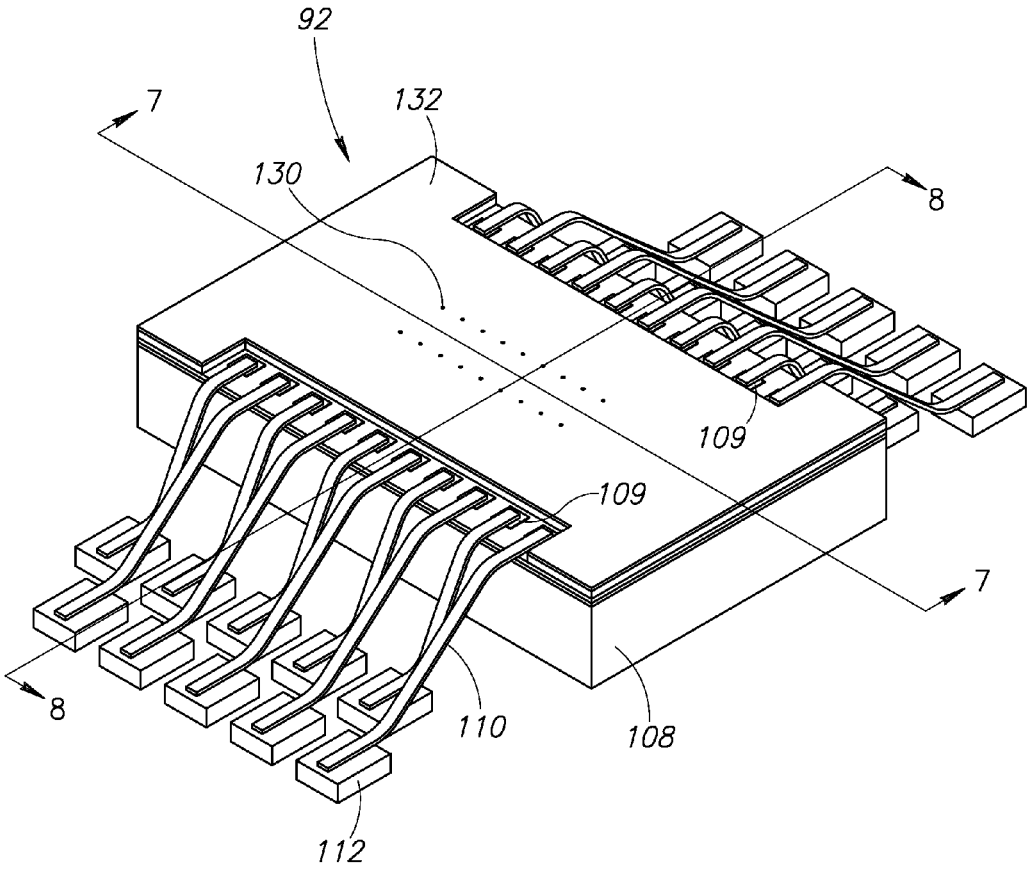
FIG. 6 is a schematic top view of a die in accordance with one embodiment.

As best shown in FIG. 6, the die includes a plurality of bond pads 109 that are electrically coupled to one or more of the leads 112 by conductive wires 110. That is, a first end of the conductive wires 110 is coupled to a respective bond pad 109 of the die 92 and a second end of the conductive wires 110 is coupled to a respective lead 112. Thus, the bond pads 109 of the die 92 are in electrical communication with the electrical contacts 74 of the microfluidic delivery member 64. A molding compound or encapsulation material 116 may be provided over the conductive wires 110, bond pads 109, and leads 112, while leaving a central portion 114 of the die 92 exposed.

Figure 7A:
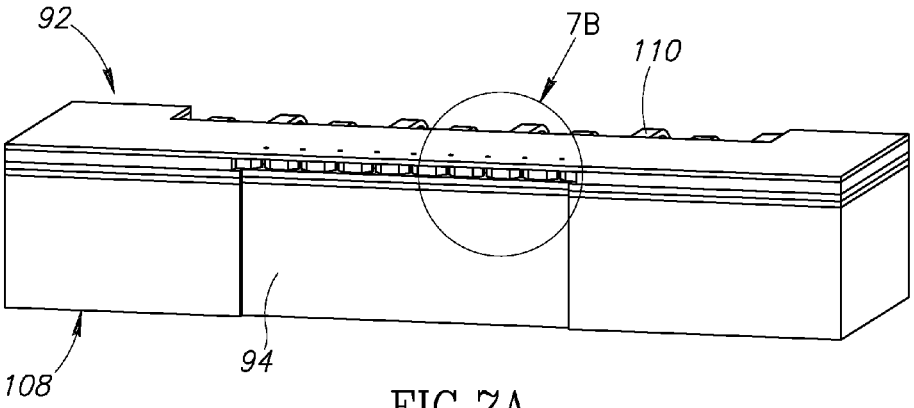
FIG. 7A is a cross-section schematic view of line 7-7 in FIG. 6.
Figure 7B:
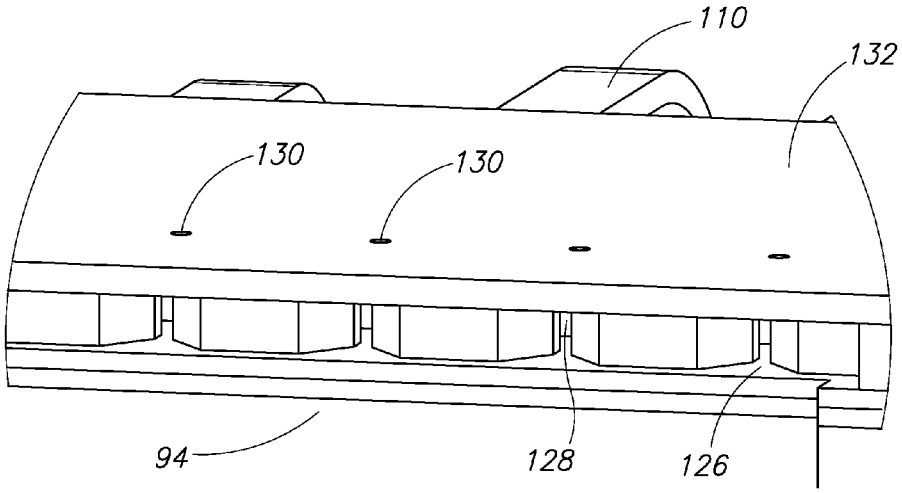
FIG. 7B is an enlarged view of a portion of FIG. 7A.
Figure 8A:
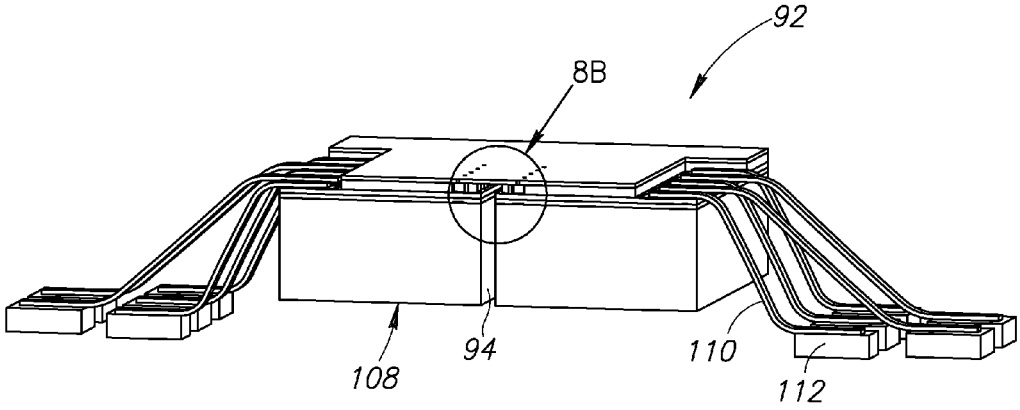
FIG. 8A is a cross-section schematic view of line 8-8 in FIG. 6.

As best shown in FIG. 4, the die 92 includes an inlet path 94 in fluid communication with the second through hole 78 on the second end 76 of the delivery member 64. With reference also to FIGS. 7 and 8, which illustrate corresponding cross sections of the die of FIG. 6, the inlet path 94 of the die 92 is in fluid communication with a channel 126 that is in fluid communication with individual chambers 128 and nozzles 130, forming a fluid path through the die 92. Above the chambers 128 is a nozzle plate 132 that includes the plurality of nozzles 130. In a first embodiment, each nozzle 130 is located above a respective one of the chambers 128 and is an opening in the nozzle plate 132 that is in fluid communication with an environment outside of the microfluidic refill cartridge 26. The die 92 may have any number of chambers 128 and nozzles 130, including one chamber and nozzle. In the illustrated embodiment, the die 92 includes 18 chambers 128 and 18 nozzles 130, each chamber associated with a respective nozzle. Alternatively, it can have 10 nozzles and 2 chambers, one chamber providing fluid for a bank of five nozzles. It is not necessary to have a one-to-one correspondence between the chambers and nozzles. In one embodiment, the nozzle plate 132 is 12 microns thick. In some embodiments, the nozzle 130 has a diameter between 20-30 microns.

Figure 8B:
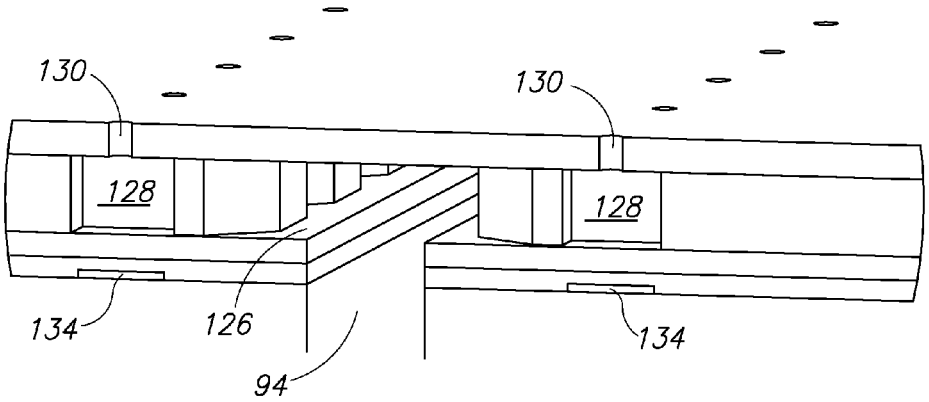
FIG. 8B is an enlarged view of a portion of FIG. 8A.

As is best shown in FIG. 8B, proximate each chamber 128 is a heating element 134 that is electrically coupled to and activated by an electrical signal being provided by a bond pad of the die 92. In use, when the fluid in each of the chambers 128 is heated by the heating element 134, the fluid vaporizes to create a bubble. The expansion that creates the bubble causes a droplet to form and eject from the nozzle 130.

Each nozzle 130 is in fluid communication with the fluid in the reservoir by a fluid path that includes the first end 82 of the fluid transport member 80, through the transport member to the second end 84, the chamber 88 above the second end 84 of the transport member, the first through hole 90 of the lid, the second through hole 78 of the PCB, through the inlet path 94 of the die, through the channel 126, to the chamber 128, and out of the nozzle 130 of the die 92. In reference again to FIG. 4, a filter 96 may be positioned between the chamber 88 and inlet path 94 of the die 92. The filter 96 is configured to prevent at least some particles from passing therethrough, thereby preventing and/or reducing blockage in the fluid path, most particularly in the nozzles 130 of the die 92. In some embodiments, the filter 96 is configured to block particles that are greater than one third of the diameter of the nozzles.

The filter 96 may be any material that blocks particles from flowing therethrough and does not break apart when exposed to the fluid, which could create further particles to block the fluid path. In one embodiment, the filter 96 is a stainless steel mesh. In other embodiments, the filter 96 is a randomly weaved mesh and may comprise polypropylene or silicon.

It is to be appreciated that in some embodiments, the fluid transport member 80 is made from one or more materials that do not react with the fluid. Thus, the fluid transport member 80 does not introduce contaminants into the fluid that could block fluid flow through the microfluidic delivery member 64. In one embodiment, the fluid transport member may replace the filter.

The second through hole 78 of the microfluidic delivery member 80 may include a liner 100 that covers exposed sidewalls 102 of the PCB 106. The liner 100 may be any material configured to protect the PCB from breaking apart, such as to prevent fibers of the PCB from separating. In that regard, the liner 100 may protect against particles from the PCB 106 entering into the fluid path and blocking the nozzles 130. For instance, the second through hole 78 may be lined with a material that is less reactive to the fluid in the reservoir than the material of the PCB. In that regard, the PCB may be protected as the fluid passes therethrough. In one embodiment, the through hole is coated with a metal material, such as gold.

Prior to use, the microfluidic refill cartridge 26 may be primed to remove air from the fluid path. During priming, air in the fluid path is replaced with fluid from the reservoir 50. In particular, fluid may be pulled up from the fluid transport member 80 to fill the chamber 88, the first through hole 90 of the lid 54, the second through hole 78 of the microfluidic delivery member 64, the inlet path 94 of the die 92, the channel 126, and the chamber 128. Priming may be performed by applying a vacuum force through the nozzles 130. The vacuum force is typically performed with the microfluidic refill cartridge in an upright position for a few seconds. In some embodiments, a vacuum force is applied for 30 to 60 seconds. The microfluidic refill cartridge 26 may also be primed by applying air pressure through a hole 140 (FIG. 9) in the lid 54 of the cartridge that is in fluid communication with the reservoir 50 to increase the air pressure on the fluid in the reservoir 50, thereby pushing fluid up the fluid transport member 80 through the fluid path. It is to be appreciated that the hole is sealed with a cover 120 (see FIG. 2B), such as elastic material that fits into at least a portion of the hole, after priming or a rigid material for press fitting into the hole, such as a small ball bearing.

Once primed, during use, when fluid exits the nozzle 130, fluid from the reservoir 50 is pulled up through the fluid path by capillary action. In that regard, as fluid exits the chamber 128, fluid automatically refills the chamber 128 by being pulled through the fluid path by capillary action.

As indicated above, the transport cover 86 in combination with the second end 84 of the fluid transport member 80 form a seal that fluidly isolates the chamber 88 from the reservoir 50 to assist in keeping the microfluidic refill cartridge 26 primed. It is to be appreciated that the chamber 88 may be at a different pressure than the reservoir 50.

It is to be appreciated that in many embodiments, the fluid transport member 80 is configured to self-prime. That is, fluid may travel from the first end 82 of the fluid transport member 80 to the second end 84 without the aid of a vacuum force or air pressure as discussed above.

The microfluidic refill cartridge 26 includes a vent path that places the reservoir in fluid communication with the external environment of the microfluidic refill cartridge 26. During use, the vent path equalizes the air pressure in the reservoir 50 with the air pressure of the external environment. That is, as fluid exits the microfluidic refill cartridge 26 through the nozzles 130, air from the external environment fills the space in the reservoir 50 that is made by the removed fluid. In that regard, the air pressure in the reservoir 50 above the fluid remains at atmosphere. This allows the microfluidic refill cartridge 26 to remain primed and prevents or at least reduces back pressure in the fluid path. That is, by equalizing the pressure in the reservoir 50, the reservoir 50 does not create a vacuum that pulls the fluid from the fluid path back into the reservoir 50.

Figure 9:
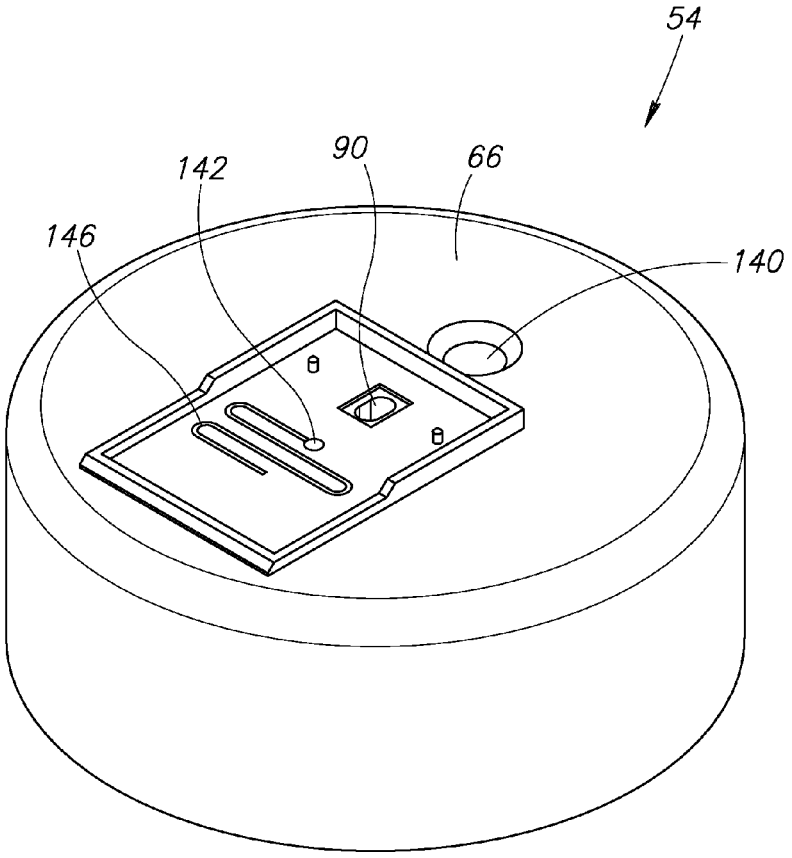
FIG. 9 is a schematic top view of the lid of the microfluidic refill cartridge without the microfluidic delivery member in accordance with one embodiment.

Referring now to FIG. 9, the vent path includes a first vent hole 142 that is a through hole in the lid 54 and a second vent hole 144 that is a through hole in the microfluidic delivery member 64 (See FIGS. 5A and 5B). The first and second vent holes 142, 144 are not aligned with each other but are in fluid communication with each other by a channel 146 formed in the upper surface 66 of the lid 54 when the microfluidic delivery member 64 is secured to the lid 54. Alternatively or additionally, the lower surface 70 of the microfluidic delivery member 64 may include a channel that places the first vent hole 142 in fluid communication with the second vent hole 144. Separating the first vent hole 142 from the second vent hole 144 by the channel 146 reduces the evaporation rate of the fluid in the reservoir 50 through the vent path.

Once primed, the nozzles 130 may be sealed to prevent de-priming of the fluid path. De-priming may occur when air enters the fluid path, such as through the nozzles 130. Additionally, the second vent hole 144 in the microfluidic delivery member 64 may also be sealed to prevent leakage and/or evaporation of the fluid 52 in the reservoir 50.

Returning to FIG. 10, the nozzles 130 and the second vent hole 144 are both located on the microfluidic delivery member 64. A single cover, such as cover 150 of FIG. 10, may therefore be used to seal both the nozzles 130 and the second vent hole 144. The cover 150 may be any cover that is configured to seal the nozzles 130 and the second vent hole 144 from atmosphere. The cover 150 is removable so that when the microfluidic refill cartridge 26 is ready for placement into the holder member 24 of the housing 12, the cover 150 may be removed to expose the nozzles 130 and second vent hole 144.

In some embodiments, the cover 150 is configured to conform to the topography of the microfluidic delivery member 64 to assist in sealing the nozzles 130 and the second vent hole 144. That is, the nozzle plate 132 that includes the nozzles 130 is in a first plane and the second vent hole 144 of the microfluidic delivery member 64 is in a second plane that is different from the first plane. The first and second planes, however, are very close together and thus are substantially co-planar. In one embodiment, the die is about 450 microns thick. Thus, with adhesive material between the die 92 and the microfluidic delivery member 64 the first and second planes may be approximately 500 microns apart. Additionally, in some embodiments, a support structure may be located between the die 92 and the microfluidic delivery member 64 making the first and second planes 800 microns or more apart. The cover 150 may be configured to conform to the first and second planes of the microfluidic delivery member 64. In that regard, at least a portion of the cover 150 may be a flexible material.

Figure 10:
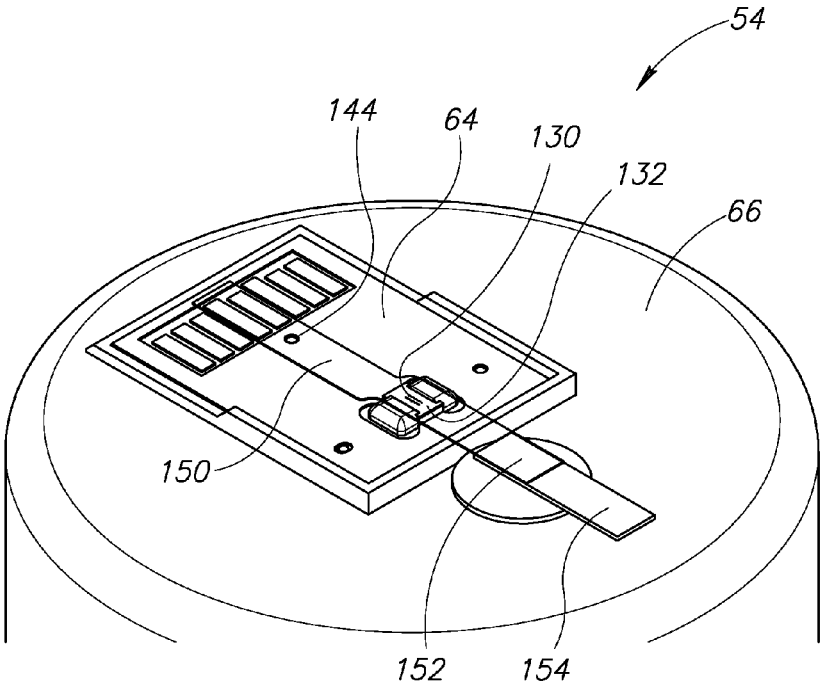
FIG. 10 is a schematic top view of the lid with a cover over the microfluidic delivery member in accordance with one embodiment.

In FIG. 10, the cover 150 is a strip of flexible tape, such as pressure sensitive tape. The tape has adhesive material that adheres to the upper surface 66 of the microfluidic delivery member 64. The adhesive material may use heat or UV to activate. The strip of tape seals the second vent hole 144 and the nozzles 130. A first end 152 of the tape may include a pull tab 154 that has a first portion that adheres to the adhesive material of the first end 152 and a second portion that extends beyond the tape. The pull tab 154 does not have adhesive material and remains moveable from the outer surface 58 of the lid 54. In that regard, the pull tab makes the tape relatively easy to remove when the microfluidic refill cartridge 26 is ready for use. For instance, the pull tab 154 may be pulled upward and peeled back over the tape, thereby lifting the tape from the microfluidic delivery member 64.

It is preferred that the adhesive material on the tape does not get into the nozzles 130 and vent hole 144 and block them after the tape is removed. That is, adhesive material that remained on the microfluidic delivery member 64 could affect the operation the microfluidic refill cartridge 26. Thus in some embodiments, the tape may have adhesive material around its perimeter and not in the center. In such embodiments, the tape may cover a larger area of the microfluidic delivery member 64 and/or may cover and adhere to the outer surface 58 of the lid 54.

Alternatively, a member (not shown) may be placed between the tape and both the second vent hole 144 and the nozzles 130. In that regard, although the entire under surface of the tape may have adhesive material, the adhesive material is prevented from touching the second vent hole 144 and the nozzles 130 while at the same time adhering the tape to the microfluidic delivery member 64, thereby sealing the nozzles 130 and second vent hole 144 from atmosphere.

Prior to placing the tape over the microfluidic delivery member 64 or the lid 54, the surfaces to which the tape will adhere may be cleaned. This will improve adherence properties between the adhesive material and the corresponding surface, such as the upper surface 66 of the microfluidic delivery member 64.

Figure 11A:
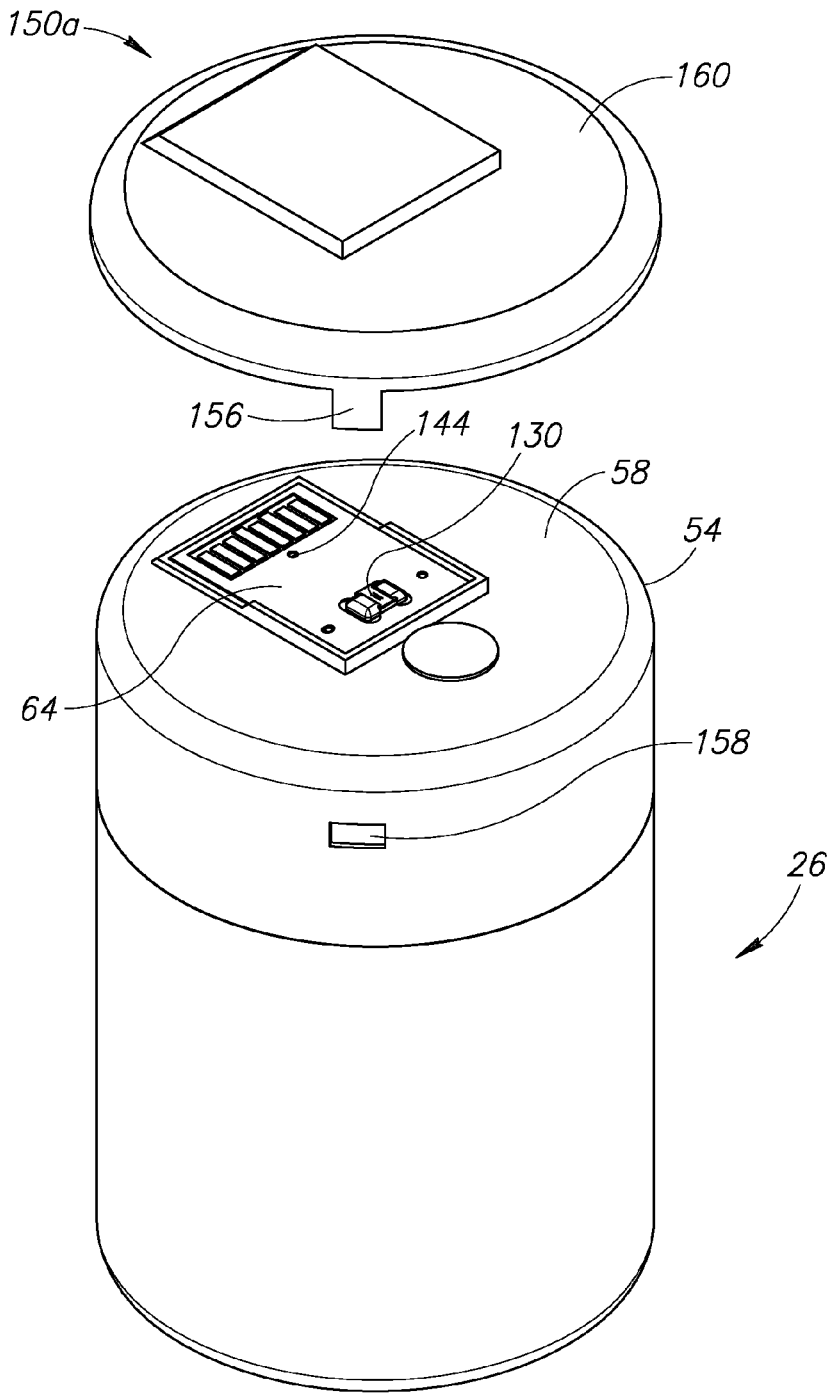
FIGS. 11A and 11B are schematic views of the microfluidic refill cartridge with a cover removed therefrom and secured thereto, respectively.
Figure 11B:
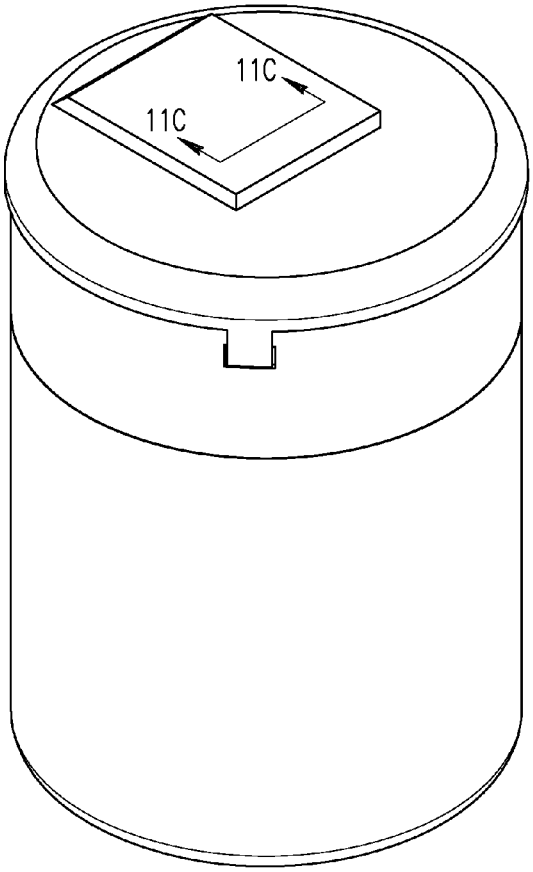
Figure 11C:
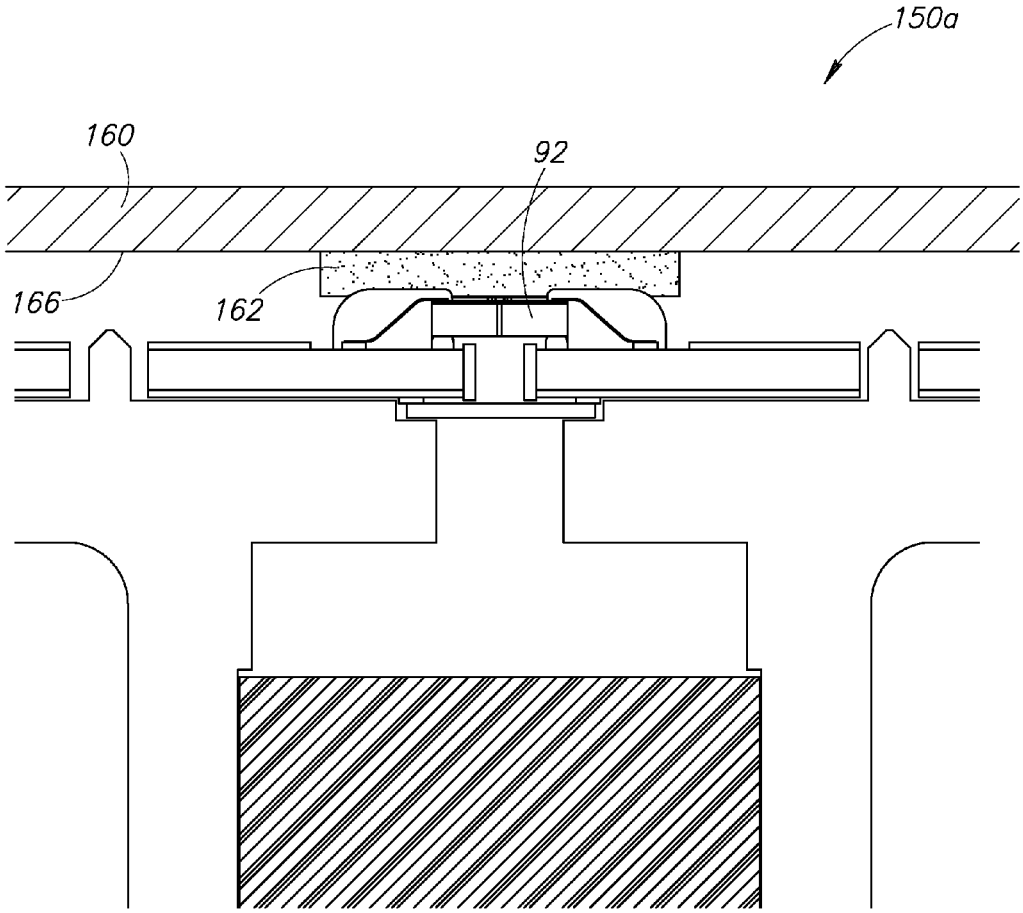
FIG. 11C is a cross-section schematic of FIG. 11B.

A cover 150*a* according to another embodiment is shown in FIGS. 11A-11C. FIG. 11A shows the cover 150*a* removed from the microfluidic refill cartridge 26 and FIG. 11B shows the cover 150*a* coupled to the microfluidic refill cartridge 26. The cover 150*a* is located over and covers the outer surface 58 of the lid 54. The cover 150*a* is removably coupled to the lid 54. For instance, in the illustrated embodiment the cover 150*a* is coupled to side surfaces of the lid 54 by one or more clips 156 that include a protrusion (not shown) that snap into indents 158 in the side surfaces of the lid 54. To remove the cover 150*a*, the clips 156 may be rotated outwardly so that the protrusion is removed from the indent 158.

The cover 150*a* includes an outer cover 160 and an inner member 162 as shown in FIG. 11C. The outer cover 160 includes the clips 156 and may be formed, such as molded, from a hard material, such as a hard plastic.

The inner member 162 is made of a flexible material, such as a compressible material, and is located over the nozzles 130 and the second vent hole 144 and may cover the entire microfluidic delivery member 64. The inner member 162 may be foam that compresses when the outer cover 160 is secured to the lid 54 to form the seal. In one embodiment, the inner member 162 includes a strip of ethylene propylene diene monomer (EPDM) rubber proximate the second vent hole 144 and the nozzles 130. When the outer cover 160 is secured to the lid 54, the inner member 162 may compress slightly to seal the nozzles 130 and the second vent hole 144. The inner member 162 may be coupled to the outer cover 160 or may be a separate structure from the outer cover 160. For instance, the inner member 162 may be secured to an inner surface 166 of the outer cover 160 or may be molded to adhere to the inner surface 166 of the outer cover 160. In that regard, the inner member 162 and the outer cover 160 form a single cover that is coupled to the lid 54 of the microfluidic refill cartridge 26 in one step.

Alternatively, the inner member 162 may be placed over a portion of or all of the microfluidic delivery member 64 as a separate piece from the outer cover 160. The outer cover 160 may then be secured to the lid 54 by the clips 156 to hold the inner member 162 in place.

Having both the second vent hole 144 and nozzles 130 on the same side of the cartridge reduces processing steps and costs for sealing the microfluidic refill cartridge.

Upon removal of the cover, the microfluidic refill cartridge 26 may be placed into the holder member of the housing. Upon depletion of the fluid in the reservoir 50, the microfluidic refill cartridge 26 may be removed from the housing 10 and replaced with another microfluidic refill cartridge 26. Alternatively, the microfluidic refill cartridge 26 may be refilled through the hole 140 in the lid 54 as best shown in FIG. 9.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A lid for covering an opening of a microfluidic refill cartridge, the lid comprising:

a body portion having first and second surfaces and a first through hole extending from the first surface to the second surface;

a microfluidic delivery member located on the first surface of the body portion, the microfluidic delivery member including:

a circuit board having a second through hole that is in fluid communication with the first through hole of the body portion; and a die coupled to the circuit board, the die including a nozzle plate having a plurality of nozzles; and a cover covering the nozzles and the second through hole of the circuit board and sealing the nozzles and the second through hole from atmosphere.

2. The lid of claim 1, wherein the nozzle plate is in a first plane and an upper surface of the circuit board is in a second plane that is substantially planar with the first plane.

3. The lid of claim 1, wherein the cover includes an adhesive layer that secures the cover to the microfluidic delivery member.

4. The lid of claim 3, wherein the cover is pressure sensitive tape.

5. The lid of claim 1, wherein the cover is flexible.

6. The lid of claim 1, wherein the cover includes a first inner member that is flexible and located over the microfluidic delivery member and a second outer cover that is rigid.

7. The lid of claim 6, wherein the first inner member conforms to the microfluidic delivery member to seal the nozzles and the second through hole.

8. The lid of claim 6, wherein the first inner member conforms to topography differences on the microfluidic delivery member.

9. The lid of claim 1, wherein the cover is secured to a portion of the body portion.

10. The lid of claim 9, further comprising clips and the cover is secured to the body portion by the clips.

11. The lid of claim 1, wherein the body portion comprises a channel that places the first through hole in fluid communication with the second through hole.

12. The lid of claim 1, wherein the cover is removable.

13. A microfluidic delivery member located on a lid of a microfluidic refill cartridge, the microfluidic delivery member comprising:

a circuit board having a first surface, a second surface opposing the first surface, and a through hole extending from the first surface to the second surface;

a die located on the first surface of the circuit board, the die including a nozzle plate having a plurality of nozzles; and a removable cover covering the plurality of nozzles and the through hole and sealing the nozzles and the through hole from atmosphere.

14. The microfluidic delivery member of claim 13, wherein the cover includes adhesive material that secures the cover to the first surface of the circuit board.

15. The microfluidic delivery member of claim 13, wherein the cover is pressure sensitive tape.

16. The microfluidic delivery member of claim 13, wherein the cover includes a flexible material.

17. The microfluidic delivery member of claim 13, wherein the nozzle plate is in a first plane and the first surface of the circuit board is in a second plane that is different from the first plane and is substantially parallel to the first plane, and wherein the cover includes a flexible material that conforms to the first plane and the second plane.

18. The microfluidic delivery member of claim 13, wherein the die includes bond pads, wherein the circuit board includes leads, the microfluidic delivery member further including conductive elements electrically coupling the bond pads of the die to the leads of the circuit board.

19. The microfluidic delivery member of claim 18, wherein the conductive elements are conductive wires, the conductive wires including first ends coupled to the electrical contacts and second ends coupled to the leads.

20. A method of providing a lid for covering an opening of a microfluidic refill cartridge, the method comprising:

forming a first through hole in a lid;

forming a channel having a first end and a second end in an upper surface of the lid, the first end of the channel being in fluid communication with the first through hole;

securing a microfluidic delivery member to the upper surface of the lid, wherein securing includes aligning a second through hole in the microfluidic delivery member with the second end of the channel so that the first through hole and the second through hole are in fluid communication with each other by the channel, the microfluidic delivery member including a nozzle plate having a plurality of nozzles;

placing the lid on a reservoir of the microfluidic refill cartridge, wherein the reservoir is holding a fluid; and sealing the plurality of nozzles and the second through hole from atmosphere.

21. The method of claim 20, wherein the plurality of nozzles and the second through hole are located in different planes, and wherein sealing the plurality of nozzles and the second through hole includes using a flexible material to seal the plurality of nozzles and the second through hole.

22. The method of claim 20, wherein sealing the plurality of nozzles and the second through hole comprises placing a strip of tape over the microfluidic delivery member to seal the plurality of nozzles and the second through hole.

23. The method of claim 20, wherein sealing the plurality of nozzles and the second through hole comprises placing a cover over the microfluidic delivery member, the cover including a hard portion that is removably coupled to the lid and a flexible portion that is located above the plurality of nozzles and the second through hole.

24. The method of claim of claim 20 further including removing the seal to expose the plurality of nozzles and the second through hole from atmosphere.

* * * * *